US008128991B2

(12) United States Patent
Garin et al.

(10) Patent No.: US 8,128,991 B2
(45) Date of Patent: Mar. 6, 2012

(54) METHOD OF SURFACE TREATING A MECHANICAL PART MADE OF HIGH-STRENGTH STEEL, AND A SEALING SYSTEM OBTAINED BY IMPLEMENTING SAID METHOD

(75) Inventors: Aude Garin, Molsheim (FR); Alain Viola, Hoenheim (FR)

(73) Assignee: Messier-Bugatti-Dowty, Velizy Villacoublay (FR)

( * ) Notice: Subject to any disclaimer, the term of this patent is extended or adjusted under 35 U.S.C. 154(b) by 101 days.

(21) Appl. No.: 12/470,864

(22) Filed: May 22, 2009

(65) Prior Publication Data

US 2009/0302550 A1 Dec. 10, 2009

(30) Foreign Application Priority Data

Jun. 4, 2008 (FR) ..... 08 03093

(51) Int. Cl.
*B05D 1/12* (2006.01)

(52) U.S. Cl. ..... 427/190; 427/201; 427/327

(58) Field of Classification Search ..... 427/190, 427/201, 327
See application file for complete search history.

(56) References Cited

U.S. PATENT DOCUMENTS 3,632,368 A * 1/1972 Nelson ..... 427/190
4,753,094 A * 6/1988 Spears ..... 72/53

FOREIGN PATENT DOCUMENTS

WO 2004/031433 A2 4/2004
WO 2004/092429 A2 10/2004
WO 2006/019983 A2 2/2006
WO 2008/010901 A2 1/2008

* cited by examiner

*Primary Examiner* — Frederick Parker
(74) *Attorney, Agent, or Firm* — Sughrue Mion, PLLC

(57) ABSTRACT

The invention is a method of treating the surface of a steel mechanical part by the successive steps of subjecting the part to finishing to lower its surface roughness; cleaning; subjecting the cleaned part to a tribo finishing step to lower surface roughness and increase wettability; and subjecting the part to ambient temperature high speed projection of tungsten disulfide platelet particles to form a dense, self-lubricating deposit on the part.

12 Claims, 2 Drawing Sheets

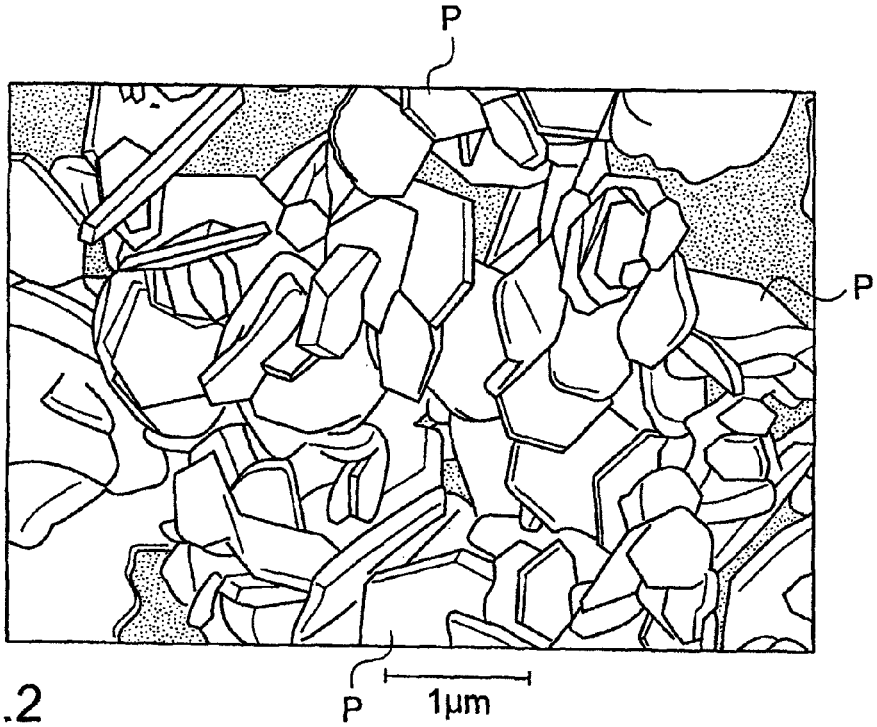
Fig.2
Fig.3
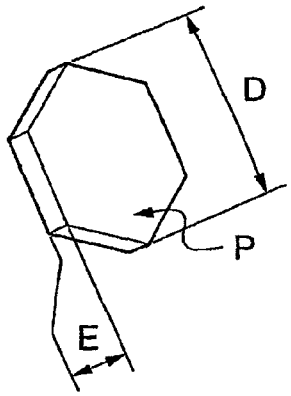
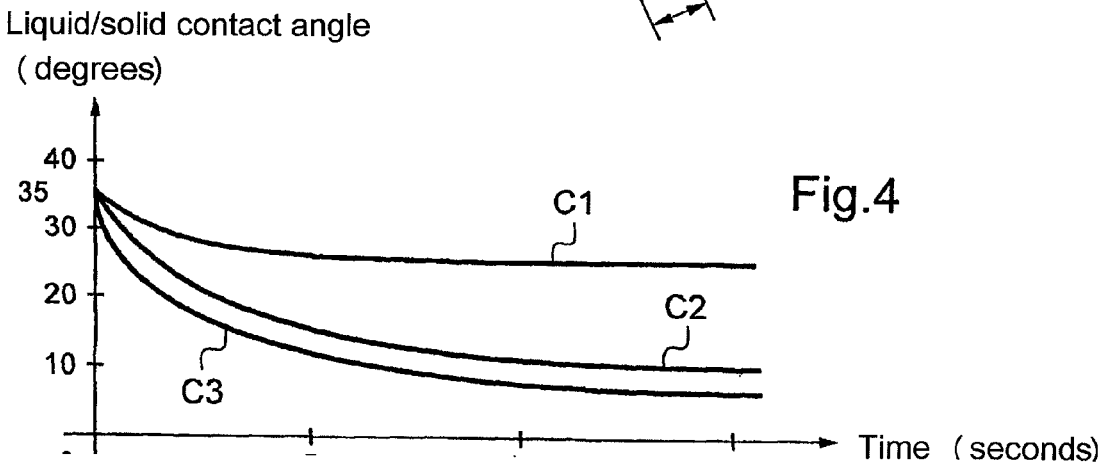
Fig.4

METHOD OF SURFACE TREATING A MECHANICAL PART MADE OF HIGH-STRENGTH STEEL, AND A SEALING SYSTEM OBTAINED BY IMPLEMENTING SAID METHOD

The present invention relates to a method of surface treating mechanical parts made of high-strength steel for the purpose of conferring on said parts friction and lubrication properties that are needed for their use, and it also relates to a sealing system obtained by implementing said method.

BACKGROUND OF THE INVENTION

It is known to perform surface treatment on metal parts in order to obtain properties in terms of friction and lubrication that are needed for their use, where the treatment is conventionally electrolytic chromium plating. An electrolytic chromium plating makes it possible to obtain a hard chromium coating and it is in very widespread use in various fields such as the field of aviation, because of its excellent properties in terms of friction, resistance to wear, and providing protection against corrosion. Electrolytic chromium plating is generally finished off by rectification so as to guarantee that the coating is of thickness that is uniform and presents a surface state corresponding to surface roughness (Ra) that is less than 0.2 micrometers (μm). The success of the above technique can be explained by the fact that the characteristics obtained after such treatment steps include firstly excellent friction strength because of good resistance to wear associated with a perfect surface state, and secondly excellent lubrication in the presence of fluids due to the microcracking effect that is inherent to hard chromium and that provides a retention zone.

Nevertheless, hard chromium plating is performed in an electrolytic cell in the presence of chromic acid based on hexavalent chromium ($Cr^{6+}$), which is harmful to the environment and to human beings. That substance is classified as being CMR (carcinogenic, mutagenic, and harmful for reproduction). In addition, like numerous electrolytic methods, that substance embrittles steels because of hydrogen diffusion, and it requires operating precautions to be taken in order to avoid burn marks in the underlying steel after rectification, where such burn marks give rise to irreversible degradation of the treated metal part.

OBJECT OF THE INVENTION

An object of the invention is to devise a method of surface treatment that is capable of replacing electrolytic chromium plating, making it possible to obtain a high level of friction strength and also very good wettability by hydraulic fluids, while conserving a level of surface roughness (Ra) that is less than or equal to 0.2 μm.

Another object of the invention is to devise a treatment method that makes it possible to avoid the above-mentioned drawbacks of electrolytic methods, while being easy to adapt to the types of mechanical part in question.

Another object of the invention is to devise a hydraulic sealing system that includes a sliding part with its surface treated by the above-specified method.

GENERAL DEFINITION OF THE INVENTION

The above-mentioned technical problem is solved in accordance with the invention by a method of treating the surface of a mechanical part made of high-strength steel, the method seeking to confer on said part friction and lubrication properties that are needed for its use, which method comprises the following successive steps:

a) subjecting the part to a primary finishing step organized to lower its surface roughness (Ra) to a value less than or equal to a first predetermined threshold;

b) then subjecting the part to surface cleaning by means of a degreasing solution;

c) subjecting the part as cleaned in this way to a tribo-finishing step organized firstly to further lower its surface roughness (Ra) to a value less than or equal to a second predetermined threshold that is less than the first predetermined threshold, and secondly to increase its wettability by hydraulic fluids; and d) subjecting the part to projection, at high speed and at ambient temperature, of tungsten bisulfide powder ($WS_2$) in the form of platelets that break, thereby creating a dense and self-lubricating deposit on the surface of said part.

It should be observed that the above treatment method, that implements a step of projecting tungsten bisulfide powder, differs radically from prior methods that also make use of tungsten bisulfide powder projection and of the kind specially developed for coating cutting tools that are harder than the part they are to cut. In this context, reference can be made to the documents WO-A-2004/031433 and WO-A-2004/092429. In particular, it should be observed that those documents implement a treatment method that does not provide for any prior degreasing step, and the step of projecting tungsten bisulfide powder makes use of a powder constituted by particles that are spherical, which particles become encrusted in corresponding recesses previously made by a sanding operation implemented using particles having the same dimensions as the powder particles.

On the contrary, in the present invention, use is made of a tungsten bisulfide powder that is in the form of platelets that break up into microparticles of powder on being projected at high speed against the surface of the part for treatment (which surface has been prepared accordingly and is free from spherical depressions) the microparticles creating on the surface a deposit that is dense and self-lubricating. Thus, projecting platelets of very small thickness gives rise to a genuine explosion of the platelets into microparticles that densify the resulting coating, such that such a process is in no way comparable to the prior processes of encrusting powder particles of spherical shape, which particles are received in recesses previously prepared for this purpose.

Advantageously, the tribo-finishing step c) includes a first step c1) of deburring by continuously agitating parts for treatment together with an oxidizing first aqueous solution containing abrasive agents until the desired surface roughness (Ra) is obtained, followed by a second step c2) of polishing by subjecting said parts to continuous agitation together with a non-oxidizing second aqueous solution containing abrasive agents. In particular, the tribo-finishing step c) includes a third step c3) of surface cleaning, followed by inspection of the surface roughness (Ra).

In an advantageous implementation, provision is made for the first predetermined roughness threshold to be substantially equal to 0.2 μm, and for the second predetermined roughness threshold to be substantially equal to 0.1 μm.

Also advantageously, the powder projected during step d) is constituted almost exclusively by pure $WS_2$, and is in the form of platelets that are substantially hexagonal in shape, with a main dimension lying in the range 0.8 μm to 1.5 μm, and with a thickness of the order of 0.1 μm.

It can also be advantageous to make provision for the method to include, after tribo-finishing step c), an additional step c1) of micro-sanding, organized to activate the surface of the part in order to increase the adhesion of the coating subsequently deposited during step d) of projecting $WS_2$ powder.

In which case, and advantageously, the micro-sanding step c') is followed by a surface cleaning step c"), and then by inspection of the surface roughness (Ra).

Also preferably, the micro-sanding step c') is organized in such a manner that the surface roughness (Ra), which is increased as a result of the micro-sanding, remains below the first predetermined roughness threshold.

In which case, and advantageously, the micro-sanding step c') is implemented using particles that are not oxides, and of a size lying in the range 5 μm to 15 μm.

Finally, and preferably, the method includes, after the $WS_2$ powder projection step d), a step d') of surface cleaning followed by inspection of surface roughness (Ra), of wettability, and of coefficient of friction.

The invention also provides a hydraulic sealing system including a slide rod slidable in a sealing assembly, in which system the sealing assembly is constituted by a guide bearing made of a first material and by a sealing gasket made of a second material of hardness less than the hardness of the first material, and in which the slide rod has an outside surface that has been worked by implementing a method presenting at least one of the above characteristics, such that said rod presents required lubrication properties relative to the guide bearing and required friction properties relative to the sealing gasket.

In particular, the first material constituting the guide bearing is a thermoplastic polymer, and the second material constituting the sealing gasket is a rubber.

Other characteristics and advantages of the invention appear more clearly in the light of the following description and the accompanying drawings, relating to a particular implementation.

BRIEF DESCRIPTION OF THE DRAWINGS

Reference is made to the figures of the accompanying drawings, in which:

FIG. 2 is a micrograph obtained by an electron microscope showing a small volume of the tungsten bisulfide powder that is used for the high speed projection at ambient temperature that is performed in the method of the invention, which powder is constituted by platelets;

FIG. 3 is a diagram showing an individual platelet of hexagonal shape constituting the tungsten bisulfide powder in question;

FIG. 4 shows the improvement of performance in terms of wettability by presenting a comparative graph that plots a plurality of curves showing how liquid/solid contact angle varies as a function of time.

DETAILED DESCRIPTION OF THE PREFERRED IMPLEMENTATION

There follows a description in greater detail of the successive steps of the method of the invention of treating the surface of a mechanical part made of high-strength steel, which method seeks to impart on said part properties of friction and of lubrication that are needed for its use.

The mechanical part in question, referenced P, is constituted for example by a stainless steel friction rod of the type used for fitting to vehicle brake pistons. Naturally, the invention is not limited in any way to one particular type of mechanical part.

Figure 1:
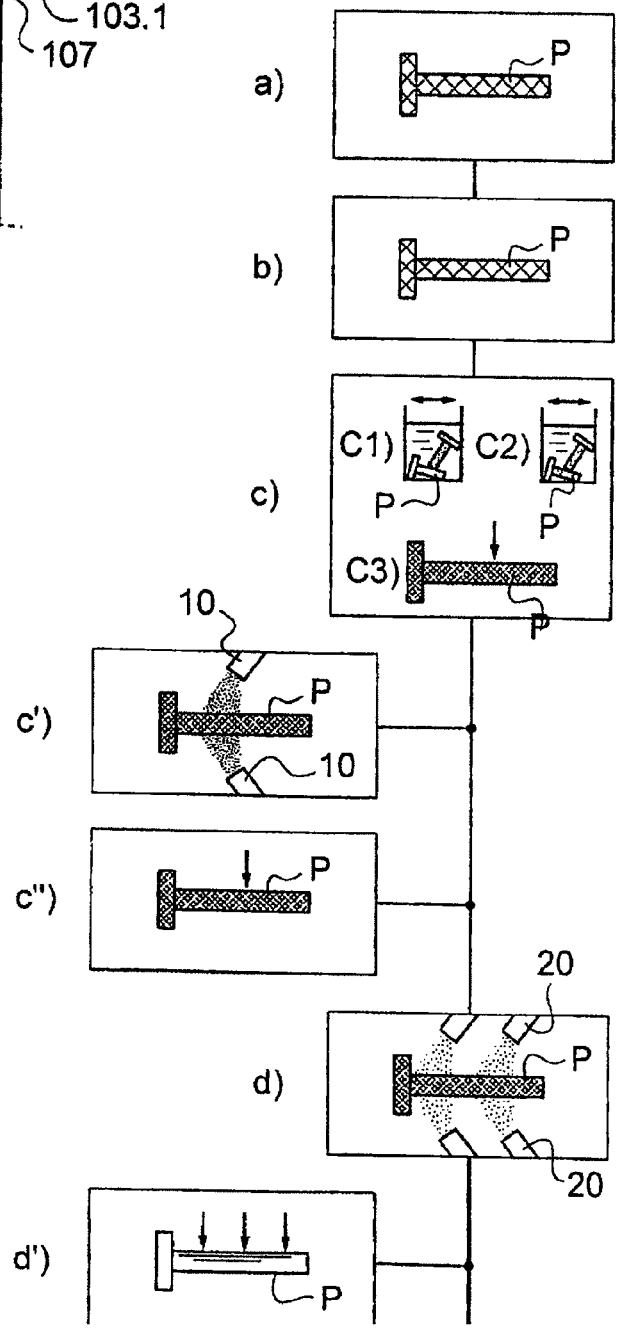
FIG. 1 is a diagram showing the various steps in a treatment method in accordance with the invention, here with optional intermediate steps of micro-sanding and an optional step of cleaning.

In FIG. 1, there can be seen a first step of the treatment method of the invention, shown diagrammatically at a). The starting metal part is a part made of steel, preferably of stainless steel, presenting high strength, i.e. of hardness that is not less than 30 HRC (i.e. on the Rockwell C scale). The part will generally already have been subjected to appropriate heat treatment enabling it to reach hardness typically of the order of 34 HRC to 39 HRC, or will have been treated with thermochemical treatment of the cementation type at low temperature or of the nitriding type at low temperature enabling it to conserve its stainless properties.

During step a), the part P is subjected to a primary finishing step that is organized to lower its surface roughness Ra to a value that is less than or equal to a first predetermined threshold S1, e.g. equal to 0.2 μm. The part P is thus finished with machining and treatment (of the thermochemical or passivation type), and is present in its final shape and dimensions. The primary finishing treatment of conventional type may comprise steps of turning, rectifying, etc. . . . , and should ensure that its roughness Ra can be made to be less than 0.2 μm, for example, once the part has been finished and is ready for the following treatment. It is recalled that the parameter Ra used herein for characterizing surface roughness is a parameter that is representative of the geometrical irregularities of a surface, and corresponds to the arithmetical mean deviation from the mean line of the roughness.

During the following step b), the part P is subjected to surface cleaning by means of a degreasing solution. This operation is important since it enables the surface of the part P to be completely cleaned of all traces of possible dirt (grease, oil, shavings, dust, plastics residues, felts, substances for providing temporary protection). The degreasing solution used is preferably of the alkaline type and it is used at a temperature in the range 35° C. to 60° C. The duration of the degreasing step is typically 5 minutes. Naturally, when the level of dirtying is very great, and in order to reduce the time needed for the degreasing treatment, it is possible to perform pre-degreasing on the metal part.

During the following step, referenced c), the part P as cleaned in this way is subjected to a tribo-finishing step organized firstly to further reduce its surface roughness Ra to a value that is less than or equal to a second predetermined threshold S2 that is less than the first predetermined threshold S1, and secondly to increase its wettability by hydraulic fluids. The hydraulic fluids in question are constituted in particular by fluids based on hydrocarbons or on ester-phosphates, or oily fluids.

Such a tribo-finishing operation is essential for preparing and optimizing the surface state of the metal part prior to the treatment by projecting tungsten bisulfide powder.

As shown diagrammatically in FIG. 1, the tribo-finishing step c) advantageously comprises a first step c1) of deburring, a second step c2) of polishing, and a third step c3) of surface cleaning, followed by inspecting surface roughness.

Deburring step c1) consists in continuously agitating parts P for treatment, generally in a vibrating bowl, together with an oxidizing first aqueous solution containing abrasive agents so as to obtain the desired surface roughness Ra. During this step, an oxide film is created on the surfaces of the parts, which film is of hardness that is less than the hardness of the underlying metal. The film is removed progressively by the mechanical action of the abrasive agents which are of hardness greater than that of the film but less than that of the underlying metal, which abrasive agents strike against the surfaces of the part, thereby reducing the roughness of said surfaces. As an indication, this first step c1) of deburring should be implemented for a duration of not less than 60 minutes.

The second step c2) of polishing preferably consists in continuously agitating parts together with a non-oxidising second aqueous solution that contains abrasive agents. This second step of polishing serves to remove all of the oxide film created during the first step c1) by the mechanical action of the abrasive agents. As an indication, the duration of the treatment for this second step c2) of polishing should not be less than 120 minutes.

At the end of these two steps c1 and c2), the surface roughness Ra is reduced to a value that is less than or equal to the second predetermined threshold S2, which is less than the first predetermined threshold S1, for example being about 0.1 μm. A step c3) is then advantageously provided for cleaning the surface, followed by a step of inspecting the surface roughness Ra, which inspection can be very reliable due to the previously performed cleaning. The cleaning in question seeks to guarantee that the result of the inspection is a measurement of surface roughness that is representative. The surface of the part then presents less dirtying than at the end of the primary finishing step a), so it is possible to use a solvent that is not very aggressive, of the acetone type.

At the end of this tribo-finishing step c), it is possible either to subject the part P directly to the following essential step referenced d), constituted by a step of projecting tungsten bisulfide powder in the form of platelets at high speed and at ambient temperature, or else in a variant to begin, prior to step d), by implementing an additional micro-sanding step, possibly followed by surface cleaning and inspecting surface roughness. These additional steps are represented herein as a step c') that is a micro-sanding step organized to activate the surface of the part P so as to increase adhesion of the coating deposited subsequently during step d) of projecting $WS_2$ powder, with said additional step c') being followed by a step c") of surface cleaning and then by inspecting the surface roughness Ra. In FIG. 1, nozzles 10 are shown diagrammatically to symbolize the micro-sanding, with particles being projected onto the part P, these particles, which are not oxides, generally having a size lying in the range 5 μm to 15 μm and preferably of the order of 10 μm. The projection of particles during step c') is performed at high speed, obtained by using a pressure of the order of 5 bars to 10 bars, with the projection jets being inclined at an angle lying substantially in the range 45° to 135°.

Naturally, such a micro-sanding step has the effect of slightly increasing the surface roughness Ra. Nevertheless, the micro-sanding step c') is organized so that the surface roughness Ra continues to remain below the first predetermined roughness threshold S1, e.g. 0.2 μm.

In FIG. 1, step c") of inspecting surface roughness Ra is symbolized by a simple arrow pointing to the part P. As in above-described step c3), surface cleaning, e.g. by means of a relatively non-aggressive solvent of the acetone type, is performed prior to inspecting the surface roughness so as to guarantee better representativity for the result of the inspecting measurement.

Whether or not the micro-sanding step should be implemented depends on the friction properties that it is desired to obtain on the metal parts, in addition to the above-mentioned wettability properties. In this respect, when micro-sanding is used, it is appropriate to implement step d) of projecting $WS_2$ powder very quickly, e.g. within a delay of not more than 120 minutes.

At the end of the tribo-finishing step c), and possibly after micro-sanding step c') and after cleaning and inspection step c"), the part P is optimally prepared for being subjected to the treatment of projecting tungsten bisulfide powder. The roughness associated with the finishing operations has been greatly diminished by the tribo-finishing operation, while the micro-sanding, if any, has also activated the surface so as to increase the adhesion of the coating that is to be formed.

During step d), the part P is therefore subjected to projection of tungsten bisulfide powder ($WS_2$) at high speed and at ambient temperature.

In accordance with an essential characteristic of the invention, the $WS_2$ powder used in the method of the invention is in the form of platelets p, as shown in FIGS. 2 and 3, thereby producing a technical effect that is radically different from that which has been obtained in prior art techniques that also make use of projecting $WS_2$ powder and that consist in projecting spherical powder particles that are encrusted in a cutter part previously prepared to present associated powder-receiving recesses. Furthermore, the teaching consisting in providing recesses for receiving spherical particles de facto implies a limit for the amount of surface roughness reduction that can be obtained, insofar as too small a value for roughness would eliminate the powder-receiving recesses, and would prevent spherical particles of $WS_2$ powder becoming encrusted. Specifically, the process is quite different when using a powder made up of platelets, i.e. very thin plates that disintegrate into microparticles on coming into contact with the surface of the part for treatment.

Preferably, the platelets p used are substantially hexagonal in shape, as shown in FIG. 3, having a main dimension referenced D lying in the range 0.8 μm to 1.5 μm, and a thickness, referenced E, of the order of 0.1 μm. When these platelets p are projected by associated nozzles, referenced 20 in FIG. 1, they break up into microparticles on coming into contact with the surface, thereby creating a deposit on the surface of said part, which deposit is dense and self-lubricating.

By way of indication, for operating conditions in which the $WS_2$ powder is projected in the form of platelets, cold and at high speed, it is possible to use a pressure of the order of 5 bars to 10 bars with an angle of inclination for the projection jet lying in the range 45° to 135° relative to the plane of the surface that is to be treated, the distance between the outlet from the projection nozzles and the part P typically lying in the range 20 millimeters (mm) to 100 mm. These operating conditions enable platelets of $WS_2$ powder to be projected at high speed so that they break up into microparticles on striking the surface of the part to be treated.

Tests undertaken by the Applicant have shown that it is then easy to obtain a coating of thickness lying in the range 0.4 μm to 0.6 μm with the liquid/solid contact angle at the surface of the $WS_2$ coating varying in a manner that is perfectly reproducible (which is not true for the prior art techniques mentioned above). The treated parts are then of a bluish gray color that is entirely characteristic of a deposit of uniform thickness. Visual inspection of the color of the part thus makes it possible to guarantee that the treatment has taken place properly and that the desired characteristics have indeed been achieved.

Furthermore, as shown in FIG. 1, it is also possible to provide for the method to include, after step d) of subjecting $WS_2$ powder, a step d') of cleaning its surface, followed by inspection. As for the preceding step c3) and c"), the surface cleaning may be performed by means of a solvent that is not very aggressive, of the acetone type, thereby guaranteeing better representativity for the results of the inspection measurements.

Performing such a final step prior to using the treated parts is of great advantage, and it serves in particular to perform three inspections, represented by three arrows in the figure, relating respectively to surface roughness, to wettability by hydraulic fluids, in particular fluids based on hydrocarbons or on ester-phosphates, or oily fluids, and to the coefficient of friction (static and/or dynamic).

This ensures that a treated part is obtained presenting surface roughness with a value Ra of less than 0.2 μm, with a dynamic friction coefficient ($WS_2$ against $WS_2$ and plane on plane) of less than 0.03, and a static friction coefficient ($WS_2$ against $WS_2$ and plane on plane) of less than 0.07.

The wettability that is obtained is also extremely discriminating insofar as it is very good for hydraulic fluid, in particular for fluids based on hydrocarbons or on ester-phosphates, or oily fluids, while being very bad for aqueous fluids.

FIG. 4 shows the improvement obtained in performance in terms of wettability for the $WS_2$ coating when made in accordance with the invention.

Curves Cl, C2, and C3 in the graph of FIG. 4 correspond to variation in the liquid/solid contact angle (in degrees) as a function of time (in seconds). Curve C1 corresponds to a treatment method of traditional type, while curves C2 and C3 correspond to treatment in accordance with the invention, respectively without and with final cleaning.

A coating is thus obtained with a coefficient of friction that is very low, and that is self-lubricating because of the continuous film created on the surface of the part, with this taking place over a very wide temperature range, the coating furthermore being lipophilic and hydrophobic. This represents considerable progress compared with the above-mentioned prior techniques corresponding to electrolytic processes.

Figure 5:
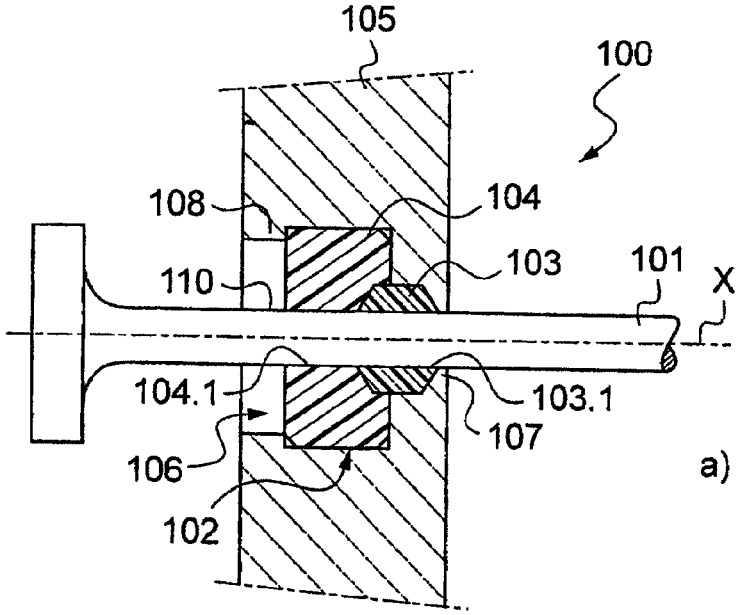
FIG. 5 is an axial section view showing a hydraulic sealing system in accordance with the invention, obtained by implementing the above-specified treatment method.

With reference to FIG. 5, there follows a description of a hydraulic sealing system in accordance with the invention obtained by implementing the above-described surface treatment method.

In FIG. 5, there can thus been seen a hydraulic sealing system referenced 100 comprising a slide rod 101 of axis X that is made of high-strength stainless steel, and that slides in a sealing assembly 102. The sealing assembly 102 is received in a housing 106 formed in a support element 105, being disposed between shoulders 107 and 108.

The sealing assembly 102 is constituted by a guide bearing 103 made of a first material and by a sealing gasket 104 made of a second material of hardness lower than that of the first material. By way of example, the first material constituting the guide bearing 103 is a thermoplastic polymer, and the second material constituting the sealing gasket 104 is a rubber. When the rod 101 moves from the right to the left in the figure, the guide bearing 103 that is capable of sliding on the rod 101 co-operates with the sealing gasket 104 by compressing it, thereby reinforcing sealing.

The outside surface 110 of the rod 101 has been treated by implementing a method as described above, such that said rod presents required properties both concerning lubrication relative to the guide bearing 103, i.e. at the interface between the outside surface 110 of the rod 101 and the inside surface 103.1 of the guide bearing 103, and in terms of friction relative to the sealing gasket 104, i.e. at the interface between the outside surface 110 of the rod 101 and the inside surface 104.1 of the sealing gasket 104, in order to avoid abrasion.

The dual function of the $WS_2$ coating lining the sliding rod 101 optimizes co-operation with both of the components 103, 104 constituting the sealing assembly 102.

Such a hydraulic sealing system is particularly advantageous for fitting to vehicle brake pistons.

This can apply in particular to a friction rod for arranging in a piston in a hydraulic ring in an aircraft brake. The role of such a friction rod is to guide the piston when applying braking force to the disk(s) of the brake, the rod being fitted with a sealing system constituting a guide bearing made of polytetrafluoroethylene and a sealing gasket made of elastomer of the ethylene propylene type. Such a rod/gasket system can then satisfy numerous requirements, in particular it can present excellent friction behavior serving to limit gasket wear and damage to the rods, and it can present good sealing for the piston against the hydraulic fluid.

The invention is not limited to the implementations described above, but on the contrary covers any variant using equivalent means to reproduce the essential characteristics specified above.

What is claimed is:

1. A method of treating the surface of a mechanical part made of high-strength steel, the method seeking to confer on said part friction and lubrication properties that are needed for its use, wherein the method comprises the following successive steps:

a) subjecting the part (P) to a primary finishing step organized to lower its surface roughness (Ra) to a value less than or equal to a first predetermined threshold (S1);

b) then subjecting the part (P) to surface cleaning by means of a degreasing solution;

c) subjecting the part (P) as cleaned in this way to a tribo-finishing step organized firstly to further lower its surface roughness (Ra) to a value less than or equal to a second predetermined threshold (S2) that is less than the first predetermined threshold (S1), and secondly to increase its wettability by hydraulic fluids; and d) subjecting the part (P) to projection, at high speed and at ambient temperature, of tungsten bisulfide ($WS_2$) powder in the form of platelets (p) that break, thereby creating a dense and self-lubricating deposit on the surface of said part.

2. A method according to claim 1, wherein the tribo-finishing step c) includes a first step c1) of deburring by continuously agitating parts (P) for treatment together with an oxidizing first aqueous solution containing abrasive agents until the desired surface roughness (Ra) is obtained, followed by a second step c2) of polishing by subjecting said parts to continuous agitation together with a non-oxidizing second aqueous solution containing abrasive agents.

3. A method according to claim 2, wherein the tribo-finishing step c) includes a third step c3) of surface cleaning, followed by inspection of the surface roughness (Ra).

4. A method according to claim 1, wherein the first predetermined roughness threshold (S1) is substantially equal to 0.2 μm, and the second predetermined roughness threshold (S2) is substantially equal to 0.1 μm.

5. A method according to claim 1, wherein the powder projected during step d) is constituted almost exclusively by pure $WS_2$, and is in the form of platelets (p) that are substantially hexagonal in shape, with a main dimension (D) lying in the range 0.8 μm to 1.5 μm, and with a thickness (E) of the order of 0.1 μm.

6. A method according to claim 1, including, after tribo-finishing step c), an additional step c') of micro-sanding, organized to activate the surface of the part (P) in order to increase the adhesion of the coating subsequently deposited during step d) of projecting $WS_2$ powder.

7. A method according to claim 6, wherein the microsanding step c') is followed by a surface cleaning step c"), and then by inspection of the surface roughness (Ra).

8. A method according to claim 6, wherein the microsanding step c') is organized in such a manner that the surface roughness (Ra), which is increased as a result of the microsanding, remains below the first predetermined roughness threshold (S1).

9. A method according to claim 6, wherein the microsanding step c') is implemented using particles that are not oxides, and of a size lying in the range 5 μm to 15 μm.

10. A method according to claim 1, including, after the $WS_2$ powder projection step d), a step d') of surface cleaning followed by inspection of surface roughness (Ra), of wettability, and of coefficient of friction.

11. A method according to claim 1, wherein the treated surface is an outside surface of a high-strength steel sliding rod of a hydraulic sealing system, said sliding rod being slidable in a sealing assembly of said hydraulic sealing system constituted by a guide bearing made of a first material and by a sealing gasket made of a second material having a hardness less than a hardness of the first material.

12. A method according to claim 1, wherein the treated surface is an outside surface of a high-strength steel sliding rod of a hydraulic sealing system, said sliding rod being slidable in a sealing assembly of said hydraulic sealing system constituted by a guide bearing made of a thermoplastic polymer and by a sealing gasket made of a rubber having a hardness less than a hardness of said thermoplastic polymer.

* * * * *